US006078246A

United States Patent [19]

Davis et al.

[11] Patent Number: 6,078,246

[45] Date of Patent: Jun. 20, 2000

[54] SNAP ACTING THERMAL SWITCHES AND METHOD OF ASSEMBLING AND ADJUSTING THERMAL SWITCHES

[75] Inventors: George D. Davis, Bellevue; Byron G. Scott, Arlington, both of Wash.

[73] Assignee: AlliedSignal, Morristown, N.J.

[21] Appl. No.: 09/258,082

[22] Filed: Feb. 25, 1999

Related U.S. Application Data

[60] Provisional application No. 60/077,362, Feb. 26, 1998.

[51] Int. Cl.[7] ..... H01H 37/54; H01H 37/04; H01H 11/00

[52] U.S. Cl. ..... 337/347; 337/333; 337/342; 337/349; 337/360; 29/622

[58] Field of Search ..... 337/318, 319, 337/360, 327, 333, 342, 343, 347, 16, 36, 52, 53, 57, 349; 29/622

[56] References Cited

U.S. PATENT DOCUMENTS

| | | | |
|---|---|---|---|
| 2,966,062 | 12/1960 | Eskin et al. | 60/527 |
| 3,091,121 | 5/1963 | Moorhead | 60/529 |
| 3,585,328 | 6/1971 | Fiore | 200/83 B |
| 3,845,440 | 10/1974 | Hunter | 337/341 |
| 4,027,385 | 6/1977 | Deubel | 29/622 |
| 4,350,967 | 9/1982 | Doherty, Jr. | 337/343 |
| 4,528,541 | 7/1985 | Hollweck et al. | 337/354 |
| 4,825,186 | 4/1989 | Bayer | 337/360 |
| 4,970,485 | 11/1990 | Wahls | 337/335 |
| 5,043,690 | 8/1991 | Wahls | 337/370 |
| 5,121,095 | 6/1992 | Ubukata et al. | 337/365 |
| 5,285,183 | 2/1994 | Asada | 337/372 |

FOREIGN PATENT DOCUMENTS

| | | | |
|---|---|---|---|
| 0 149 962 A2 | 12/1984 | European Pat. Off. | H01H 37/54 |
| 4029527A1 | 3/1992 | Germany | F04D 27/00 |
| 2021 320 | 5/1979 | United Kingdom | H01H 37/54 |
| 2088132 | 6/1982 | United Kingdom | H01H 37/54 |

*Primary Examiner*—Leo P. Picard
*Assistant Examiner*—Anatoly Vortman

[57] ABSTRACT

A method and apparatus for setting striker pin length and armature spring force in a thermal switch. An armature support structure is deformed in order to adjust armature spring force with the result of a spring force which remains constant over time and thermal cycling.

6 Claims, 2 Drawing Sheets

SNAP ACTING THERMAL SWITCHES AND METHOD OF ASSEMBLING AND ADJUSTING THERMAL SWITCHES

PRIORITY APPLICATIONS

This application claims priority from U.S. Provisional Application Ser. No. 60/077,362 filed Feb. 26, 1998.

FIELD OF THE INVENTION

The invention relates to snap acting thermal switches and methods of assembling and adjusting thermal switches.

BACKGROUND OF THE INVENTION

Several applications depend upon high current switching ability, high dielectric breakdown voltage, high vibration and shock resistance, high reliability, extreme cleanliness or low contamination particle count, and narrow temperature differential between the open and closed switch positions. For example, qualification for many space and military applications requires a 5 ampere, 28 volt D.C. switching capability capable of 100,000 cycles and no internal particles measuring 0.001 inch or larger which may become lodged between the switch contacts and cause an open condition. Temperature differential is measured as the number of degrees above or below the switch set point where the bi-metal actuator disc reverses state and thereby reverses the open/closed condition of the switch. Temperature differential is often required to be quite narrow, for example, on the order of 1 degree Centigrade or less.

Snap acting thermal switches are presently being used. Snap acting bi-metal disc-type thermal switches typically have a contact movably mounted on a carrier with the movement of the carrier controlled by a bi-metal actuator disc. The bi-metal disc actuates the switch by changing from a convex state to a concave state at a temperature set point dependent upon the difference in thermal expansion coefficients of the two materials forming the bi-metallic disc. The bi-metal actuator disc alternates between a convex state and a concave state as the ambient temperature rises above or drops below the switch set point. The change in state exerts force on the movable carrier to open the contacts or relieves the force to close the contacts. The movable carrier is typically a spring, for example, a leaf spring, commonly referred to as an armature, which tends to force the switch movable contact against a stationary contact to close a circuit. The armature is typically an electrically conductive current carrying member of the switch circuit. The actuating movement of the bi-metal disc is coupled to the contact mechanism through an insulated coupling pin or plunger commonly referred to as a striker pin which is fastened in fixed relation to the movable carrier.

The spring rate or spring force of the contact carrier spring or armature is instrumental in determining the switch closing set point. The armature spring holds the contacts closed when the bi-metal actuator disc is not engaged with the striker pin. When the bi-metal actuator disc changes state to force the switch contacts into an open position, spring force is exerted against the bi-metal actuator disc by the armature spring acting through the striker pin. Thus, when the contacts are in the open position, the armature spring exerts force on the bi-metal actuator disc tending to force the bi-metal disc to change its convex/concave state. Thus, the armature spring force affects the temperature at which the disc changes its convex/concave state by supplying extra force needed to overcome hoop stress in the disc during the transition between the convex and concave states. The armature spring force is typically adjusted into a narrow range of spring forces by deforming the armature itself either toward the bi-metal actuator disc to increase spring force or away from the bi-metal actuator disc to decrease spring force. Deformation of the armature introduces stresses into the armature spring which lead to switch instability as the stresses relieve over time and thermal cycling. As the stresses relieve, effective armature spring force changes. Changes in effective armature spring force results in thermal drift of the switch set point.

This striker pin is normally formed of a vitreous material, for example, ceramic, alumina or steatite. The length of the striker pin must be precisely controlled to properly couple the snap travel of the bi-metal disc to the contacts. Improper striker pin lengths result in improper switch action and either gross reduction in switching life or susceptibility to intermittent contact closings during vibration. Normal manufacturing tolerances do not allow the striker pin length to be controlled directly without extraordinarily tight controls on the several components that make up the assembly. As a result, normal practice has been to manufacture the detail components to common tolerances and compensate for the total accumulation of plus and minus tolerances by using a striker pin fitted to each specific assembly. Several common methods are now used to fit the striker pin length to each switch assembly. Each have imitations and disadvantages.

One commonly used current method utilizes a free-floating coupling pin, manufactured in incremental lengths to cover all possible combinations of tolerance accumulations. Each switch-contact assembly is measured using specialized gauges which relate the geometry of each assembly to a specific pin size. The specified pin length is selected from available stock and installed in the switch. Since this design approach does not fix the striker pin to any support, it is free to rattle and bounce within the enclosure whereby contamination from rubbing surfaces can be generated. Vibration and shock exposures can also impact the floating striker pin against the contact assembly thereby causing inadvertent openings or closings of switch contacts. Fractures of the pin as a result of extreme shock and vibration levels have been observed in switches using the floating striker pin approach.

Another commonly used procedure for obtaining correct pin length is mechanically attaching a pin of sufficient length to compensate for all combinations of component part tolerances to a fixed part of the assembly and trim the point or lower end to the specific dimension required. This procedure provides superior resistance to high vibration and shock levels because no "loose" parts are in the disc-to-contact train. However, the trimming operation inherently creates debris in the form of chips or grindings which have the potential for contaminating switch contacts. Elaborate procedures are often required to thoroughly clean the switch assembly.

Furthermore, in grinding the striker pin to length, a sharp-edged, flat tip or lower end is formed which results in harmful abrasive wear of the actuating bi-metal disc by repeated contact therewith. Additionally, the sharp edge left by the grinding operation tends to chip whereby chips break off during operation to cause contamination within the finished switch assembly.

Yet another procedure for obtaining proper striker pin length is described in U.S. Pat. No. 4,201,967 ('967). The procedure of '967 provides a striker pin of ceramic material bonded to a carrier by and adhesive layer of controlled thickness for establishing the effective length of the striker pin. The patent also discloses a method of manufacture including a tool used therein. The procedure of '967 overcomes some of the problems of the prior art by providing a spherical lower end which does not require grinding. However, this procedure is only accomplished by using tedious and time-consuming assembly techniques.

Still another procedure for obtaining proper striker pin length utilizes a fixed, pre-formed striker pin with a cap adjustably fitted thereon. In this procedure, a cup-shaped metal cap is mounted onto the lower end of the striker pin using a small layer of adhesive between the striker pin and the cap. This procedure also overcomes some of the problems of the prior art by simplifying the tooling and assembly techniques required. However, this procedure lowers the switch's operational vibration and shock environmental limits because the striker pin cap and adhesive layer increase the mass of the striker pin. The spring constant of the movable mount or armature on which the contact and striker pin are mounted must be increased to overcome the increased mass of the striker pin cap and adhesive and prevent contact chatter. Switch performance is degraded because the bi-metal actuator disc must overcome the greater spring force and separate the contacts. For example, the increased actuator strength required to overcome the greater spring force increases the temperature differential between the concave and convex states of the bimetallic actuator disc, effectively increasing the overlap between the switch's open and closed positions. Switch dielectric strength is degraded because the electrically conductive metal striker pin cap reduces the effective insulated path between the actuating bi-metal disc and the electrically conductive spring mount. Furthermore, sputter coating of the insulating portion of the striker pin during make and break operation of the contacts over repeated cycling reduces the insulation resistance of the circuit.

One more procedure for obtaining proper striker pin length is accomplished by providing a fixed length striker pin and adjusting the striker pints length relative to the bi-metal actuator disc by deforming either or both of the armature spring and the stationary contact. This procedure induces stresses into the armature spring which lead to switch instability as the stresses relieve over time and thermal cycling. As the stresses relieve, effective striker pin length and armature spring force change. Changes in either or both of effective striker pin length and armature spring force result in thermal drift of the switch set point and increased contact chatter during opening and closing of the contacts. Furthermore, deforming the stationary contact degrades structural integrity of its mechanical mount to its support structure with unpredictable results.

Failing to use one of the above procedures to obtain a proper striker pin length: matching a striker pin to a specific assembly; trimming the striker pin in the assembly by grinding; adjusting the effective striker pin length with a layer of adhesive; providing a striker pin cap adhered to the striker pin with a layer of adhesive; and deforming either or both of the armature spring and the stationary contact, renders the snap acting thermal switch inoperative either because the striker pin is too long to allow the contacts to close or too short for the bi-metal actuator disc to open the contacts. However, as discussed, each procedure has drawbacks. Therefore, a procedure overcoming the limitations of the prior art is desirable.

SUMMARY OF THE INVENTION

The present invention overcomes the limitations of the prior art by providing a striker pin length setting procedure which provides the advantages of the prior designs while avoiding the disadvantages thereof. The present invention eliminates the striker pin cap from the thermal switch assembly and significantly changes the assembly process, resulting in significant performance improvements and cost savings. The present invention provides a procedure for obtaining a correct striker pin length while avoiding striker pin length selection process, the trimming or grinding operation, the adjusting procedure using an adhesive layer, the installation of a striker pin cap and the deformation of the armature spring.

The present invention provides a method of adjusting armature pressure or spring force adjustment which neither compromises the structural integrity of the stationary contact or its mechanical mounting to its support structure nor introduces stresses into either the stationary contact or the armature spring. According to one aspect of the invention, the invention provides a procedure of obtaining proper armature spring force by permanently deforming the armature support structure. The support structure, while typically more robust than either the stationary contact or the armature spring, is formed of a malleable material which can be deformed without introduction of stresses. Thus, armature spring force adjustment by deformation of the armature support structure according to one aspect of the invention, results in a spring force which remains constant over time and thermal cycling.

According to yet another aspect of the invention, the armature spring force is provided by providing a cross-section reduced or "necked down" portion of the armature spring support structure.

According to another aspect of the invention, the invention provides a procedure of obtaining proper striker pin length by adjusting the position of other components within the switch assembly. The invention provides a switch having a proper striker pin length relative the other components of the switch assembly by providing a spacer having a variable position relative to the striker pin such that the striker pin lower end is fixed at a proper distance from the bi-metal actuator disc to ensure proper snap action of the bi-metal actuator disc. Furthermore, the invention provides proper striker pin length without utilizing any of the striker pin length selection process, the trimming or grinding operation, the adjusting procedure using an adhesive layer, the installation of a striker pin cap, deformation of the stationary contact and the deformation of the armature spring of the prior art.

DETAILED DESCRIPTION OF THE PREFERRED EMBODIMENT(S)

Figure 1:
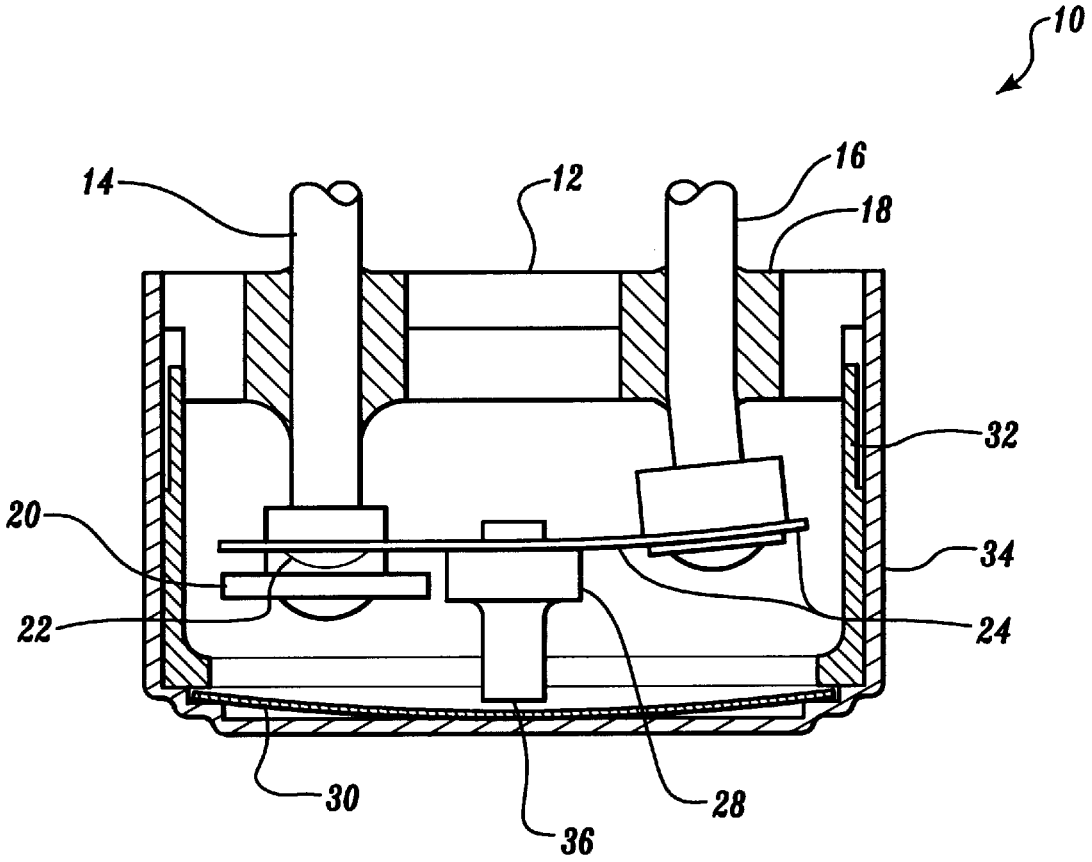
FIG. 1 is a cut-away view of a thermal switch formed in accordance with the present invention.

The present invention provides a capless thermal switch with a highly durable process for adjusting armature spring force. As shown in FIG. 1, a switch assembly 10 includes a header 12 into which terminal support posts 14 and 16 are installed. Either the header 12 is non-electrically conducting or the terminal support posts 14 and 16 are electrically insulated from the header 12. For example, the header 12 may be formed of steel and the terminal support posts 14 and 16 pass through holes bored in the header 12, the terminal posts 14 and 16 are secured in the header 12 by embedding the posts 14 and 16 in an insulating glass 18. The terminal posts 14 and 16 are typically formed of a relatively malleable and electrically conductive material, for example, alloy 52. The terminal posts 14 and 16 also provide the electrical connection to the internal switch (stationary and armature) contacts 20 and 22. The stationary contact 20 is fixed to the first terminal post 14, for example, by passing the internal end of the terminal post 14 through a hole formed in the stationary contact 20 and riveting the stationary contact 20 in place. An armature spring 24 is fixed to the second terminal post 16 in a similar manner. The armature spring 24 is fitted with a contact 22 and is formed of a malleable electrically conductive material, for example, gold or silver. The armature spring 24 provides a movable mount or carrier for the armature contact 22 which forces the armature contact 22 into contact with the stationary contact 20 to close the circuit. A striker pin 28 formed of an insulating material is mounted on the armature spring 24 whereby a force exerted on the striker pin 28 is translated to the armature spring 24 which forces the armature spring 24 to rotate about its design point of rotation thereby moving the armature contact 22 away from the stationary contact 20 and opening the circuit. The striker pin 28 has an upper end mounted to the armature spring 24 and a free lower end 36.

Also included in the switch assembly 10 is a bi-metal disc actuator 30 having both a stable convex geometrical state and a stable concave geometrical state. The bi-metal disc actuator 30 is formed of two materials having different coefficients of thermal expansion bonded together. The disc changes state between its convex geometrical state and its concave geometrical state depending on the ambient temperature the bi-metal disc actuator 30 experiences. The ambient temperature at which the bi-metal disc actuator 30 changes state is commonly referred to as the set point. Typically, a temperature differential exists between the two opposing geometrical states such that the transition from a first geometrical state to a second geometrical state occurs at a different temperature than that at which the bi-metal disc actuator 30 returns to the first geometrical state from the second geometrical state. This temperature or thermal differential is a result of the hoop stress generated by the outer rim of the disc which must be overcome by the force generated by the difference in thermal expansion coefficients between the two materials of the bi-metal disc in order for the bi-metal disc actuator 30 to change states. An external force exerted on the bi-metal disc 30 supplements the force generated by the difference in thermal expansion coefficients between the two materials of the bi-metal disc 30 and changes the temperature at which the bi-metal disc 30 changes geometrical state.

Figure 2:
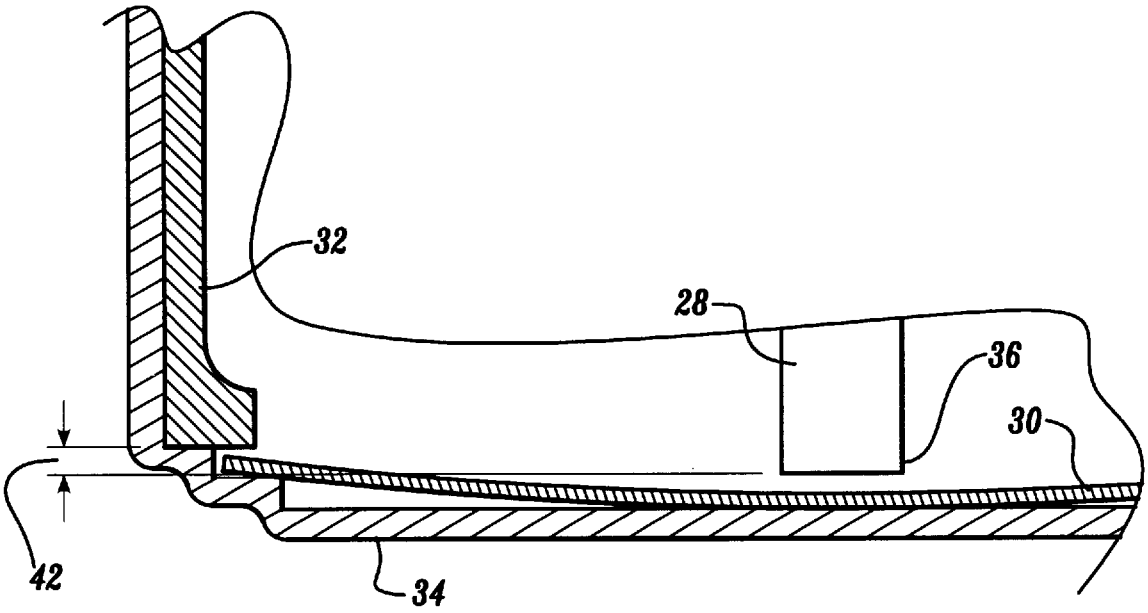
FIGS. 2 and 3 are detailed cut-away views of the thermal switch shown in FIG. 1.

As shown in FIG. 2, the bi-metal disc actuator 30 is positioned in close proximity to the striker pin's lower end 36 and captured between the bottom end of a spacer 32 fixed to the header 12 and the inside of a cover 34 also fixed to the header 12. The bi-metal disc actuator 30 is positioned such that transition from one geometrical state to the other geometrical state applies and relieves pressure on the striker pin lower end 36 to open and close the circuit. In the open position, the bi-metal disc actuator 30 presses against the striker pin lower end 36 to open the contacts 20 and 22 against the pressure of the armature spring 24. Thus, in the open contact state the resisting force of the armature spring 24 presses against the bi-metal disc actuator 30 thereby exerting a force on the bi-metal disc 30 which supplements the force generated by the difference in thermal expansion coefficients between the two materials of the bi-metal disc. Thus, the armature spring 24 forcechanges the temperature at which the bi-metal disc changes geometrical state.

Figure 3:
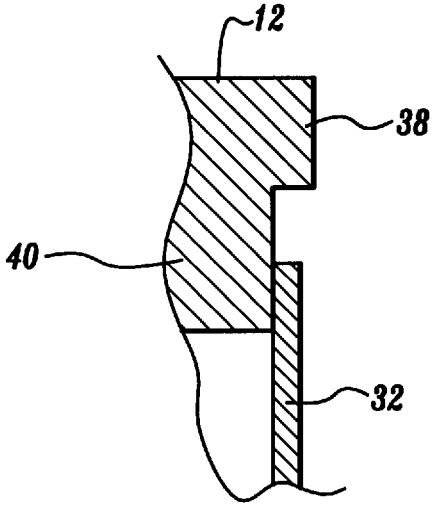

As shown in FIG. 3, the header 12 typically is a flat round plate with a first portion and second portion 38 and 40. The first portion 38 is greater than the radius of the second portion 40. Regarding the radii of the portions 38 and 40, they may be opposite that described above provided they produce the desired functionality described below. The second portion forms a shoulder over which the spacer 32 is forced. The spacer 32 and header 12 are manufactured to have an interference or press fit such that the spacer 32, once pressed onto the header 12, is firmly fixed in place. Traditionally, the spacer 32 has been pressed onto the header 12 until it bottoms out on the first portion 38.

As the spacer 32 is being forced into position over the second portion 40, the distance 42 of the striker pin's lower end 36 relative to the end of the spacer 32 is continuously beings measured. The distance 42 is a measure of how far the striker pin's lower end 36 extends beyond the lower end of the spacer 32. When the measurement of the striker pin's lower end 36 relative to the spacer's lower end reaches its desired value, the pressure fitting of the spacer 32 to the second portion 40 ceases. In other words, the spacer 32 of the present invention is press fit onto the second portion 40 of the header 12 to a point whereby the final effective striker pin length 42 is set by the spacer 32 installation. The present invention provides a spacer 32 having a first predetermined length and a striker pin 28 having a second predetermined length whereby the combination of spacer length and striker pin length provide a range of final effective striker pin lengths according to the requirements of any specific application. The spacer 32 is press fit onto the second portion 40 of the header 12 such that the spacer 32 engages at least a portion of the second portion 40 up to the entire second portion 40 with the spacer 32 bottomed out on the header plate. Thus, proper striker pin length 42 is obtained without resort to any of the striker pin length setting processes of the prior art and eliminating the disadvantages associated with the prior art. Rather, the present invention improves the precision of the striker pin length 42 by an estimated factor of 5. The measuring of striker pin length 42 and the press fitting of the spacer 32 are preferably performed by a high precision sensor and mechanical device.

FIG. 1 also illustrates armature spring 24 rate adjustment according to one embodiment of the present invention. The armature spring 24 is supported by the armature terminal post 16. According to the present invention, armature pressure is adjusted by deforming the armature terminal post 42 within the switch assembly 10. Prior to spacer 32 installation, the terminal post 16 is deformed away from the stationary contact 20 (shown) or toward the stationary contact 20 (not shown) to adjust the armature spring force to within the desirable range of limits. Furthermore, because the adjustment is made by deforming the relatively malleable terminal post, the armature spring force is permanently adjusted to a new spring rate that will not change over time or temperature cycling due to time or temperature dependent stress relief.

While the preferred embodiment of the invention has been illustrated and described, it will be appreciated that various changes can be made therein without departing from the spirit and scope of the invention.

What is claimed is:

1. A method for setting striker pin position within a thermal switch, said method comprising:

detecting separation between said striker pin and a first end of a spacer; and press fitting the spacer onto a header based on the detected separation and a desired separation.

2. The method of claim 1, further comprising:

deforming a support post coupled to an armature spring based on a desired armature spring force.

3. A thermal switch assembly comprising:

a spacer with a first end and second end;

a cover;

a header formed to slidably receive under force the first end of the spacer;

two support posts mounted through the header;

a striker pin with a first end and a second end;

an armature spring mounted to one of the support posts and the first end of the striker pin;

wherein said spacer is positioned at one of a plurality of possible spacer positions and the first end of the spacer press fit onto the header whereby a distance based on a desired gap between the second end of the spacer and the second end of the striker pin is obtained.

4. The assembly of claim 3, wherein said header is cylindrical in shape with a first and second portion, wherein the first portion has a larger radius than the second portion and the second portion is formed to receive the spacer under pressure.

5. A thermal switch assembly comprising:

a spacer with a first end and second end;

a cover;

a header formed to slidably receive under force the first end of the spacer;

two support posts mounted through the header wherein one or more said support posts is constructed of a malleable metal;

a striker pin with a first end and a second end;

an armature spring mounted to one of the support posts and the first end of the striker pin, wherein the first end of the spacer is press fit onto the header a distance based oil a desired gap between the second end of the spacer and the second end of the striker pin, and wherein said support post of malleable metal is deformed based on a desired armature spring force.

6. The assembly of claim 5, wherein said header is cylindrical in shape with a first and second portion, wherein the first portion has a larger radius than the second portion and the second portion is formed to receive the spacer under pressure.

* * * * *